US005129522A

United States Patent [19]

Druskoczi

[11] Patent Number: 5,129,522

[45] Date of Patent: Jul. 14, 1992

[54] DENIM BOOK COVER AND KIT FOR MAKING SAME

[76] Inventor: Sue Druskoczi, 439 Knapps Hwy., Fairfield, Conn. 06430

[21] Appl. No.: 669,635

[22] Filed: Mar. 14, 1991

[51] Int. Cl.[5] ..... B65D 85/00

[52] U.S. Cl. ..... 206/574; 206/424; 206/575

[58] Field of Search ..... 206/223, 225, 227, 229, 206/424, 574, 575, 577, 582

[56] References Cited

U.S. PATENT DOCUMENTS

| | | | |
|---|---|---|---|
| H467 | 5/1988 | Gladden | 206/575 |
| 1,733,825 | 10/1929 | Rosenthal | 206/574 |
| 2,681,092 | 6/1954 | Davis | 206/574 |
| 3,907,107 | 9/1975 | Vercollone | 206/574 |
| 3,964,529 | 6/1976 | Brod | 206/575 |
| 4,111,341 | 9/1978 | Carrozo | 206/574 |
| 4,127,191 | 11/1978 | Cave | 206/574 |
| 4,391,370 | 7/1983 | Dalbo | 206/574 |
| 4,584,042 | 4/1986 | Wandrolk | 206/575 |
| 4,951,483 | 8/1990 | Van Olphen | 206/575 |

*Primary Examiner*—Jimmy G. Foster

*Attorney, Agent, or Firm*—Arthur T. Fattibene; Paul A. Fattibene

[57] ABSTRACT

A do-it-yourself book cover and kit therefor, which includes a blank of denim material formed as a rectangular blank having opposed marginal edges that are reversely folded and secured in place to define opposed end pockets for receiving the free ends of a book cover. Various decorative components are provided whereby the assembled book cover can be personalized to the user's desire or fancy. The various component parts are conveniently packaged in a container compartmentalized for storing and/or organizing the various component parts necessary for constructing the book cover.

3 Claims, 3 Drawing Sheets

DENIM BOOK COVER AND KIT FOR MAKING SAME

This invention is directed to a book cover made of a hardy denim material which can be readily personalized by the user, an a kit for making the same.

Heretofore, various forms of book covers or book protectors have been utilized to protect a book from excessive wear and/or abuse. The protection of books is especially critical in the public grade schools and high schools, as the same textbooks are used and distributed to succeeding classes. Generally, such students are required to provide covers for such textbooks so supplied. Generally, such covers are simply made of brown wrapping paper, which has minimum durability. Frequently, such paper covers would wear out long before the need for such books was completed. As a result, during most of the book's use, the book was not protected by a durable cover. Thus, the useful life of the book was substantially diminished. Another disadvantage of such prior known book covers was that they had no appeal to the user. Such lack of appeal oftentimes affected the manner in which the user treated or handled the book, because the user generally took no pride in the book or its cover.

In an effort to overcome these observed difficulties, a number of patented book covers are known. U.S. Pat. No. 4,832,648 is directed to an animated book cover. U.S. Pat. 4,036,417 discloses a cover and carrying arrangement requiring a number of component parts to be assembled in a particular manner that is relatively complex. U.S. Pat. No. 399,570 is directed to a writing tablet having an ornate cover hingedly connected to the tablet. Another book protector is disclosed in U.S. Pat. No. 4,083,582. As described therein, the book protector is formed to merely protect the edges of a book and is constructed in a manner so as to zip the book between open and closed position by a zipper. Other book or pad constructions are noted in U.S. Pat. Nos. 4,075,702; 2,120,818 and 2,120,819; a wallet like enclosure for containing a calculator and/or checks, and sample holders respectively.

OBJECTS

An object of this invention is to provide a durable book cover that is relatively simple in construction and positive in operation.

Another object is to provide for a do-it-yourself book cover which is durable and fashionable.

Another object is to provide a book cover which is durable and which can be readily personalized by the user as desired and to reflect the user's creativity.

Another object is to provide a durable book cover constructed so as to instill user's pride in the book protected thereby.

Another object is to provide a do-it-yourself book cover kit which will enable the user to exercise his or her creative skills in the construction of a book cover.

Another object is to provide a kit containing the book cover and components for personalizing the cover which is relatively simple and inexpensive.

SUMMARY OF THE INVENTION

The foregoing objects and other features and advantages are attained by a book cover which is formed of a readily durable denim material which comprises a generally rectangular blank of denim. The book cover is formed by reversely folding the longitudinal marginal edges of the blank onto itself to form opposed longitudinal pockets. The opposed side marginal portions of the blank so formed are reversely folded upon itself to provide end pockets adapted to receive the free ends of a book cover. A tack stitch is provided to secure the reversely folded side marginal portions to the blank in the folded position thereof. In the assembled position of the blank, the opposed covers of a book are respectively received in the opposed pockets so formed so as to provide a complete cover for a book. As the blank is formed of a denim material, it provides for a durable book cover that can be repeatedly used from semester to semester by the user. Because denim is considered to be a currently fashionable material, the cover can be readily personalized by the user by the application of various decals and/or "press on" patches. Also, the denim cover can be painted or suitably decorated in accordance with the individual creativity of the user. In accordance with this invention, the component parts necessary for creating a fashionable cover are provided in a kit which includes a container which is compartmentalized to receive the respective components in an orderly and ready to use manner. The invention further contemplates other kit forms which require a minimum or no external packaging.

FEATURES

A feature of this invention is to provide a book cover formed of a readily durable denim material which can be readily decorated to the user's desire.

Another feature resides in the provision of a student or user being able to make a fashionable book cover in accordance with his or her own creativity that will instill pride in the book or property protected by such cover.

Another feature resides in the provision of the book cover in kit form containing the component parts necessary for enabling one to fashion his or her own durable book cover.

IN THE DRAWINGS

DETAIL DESCRIPTION

Figure 2:
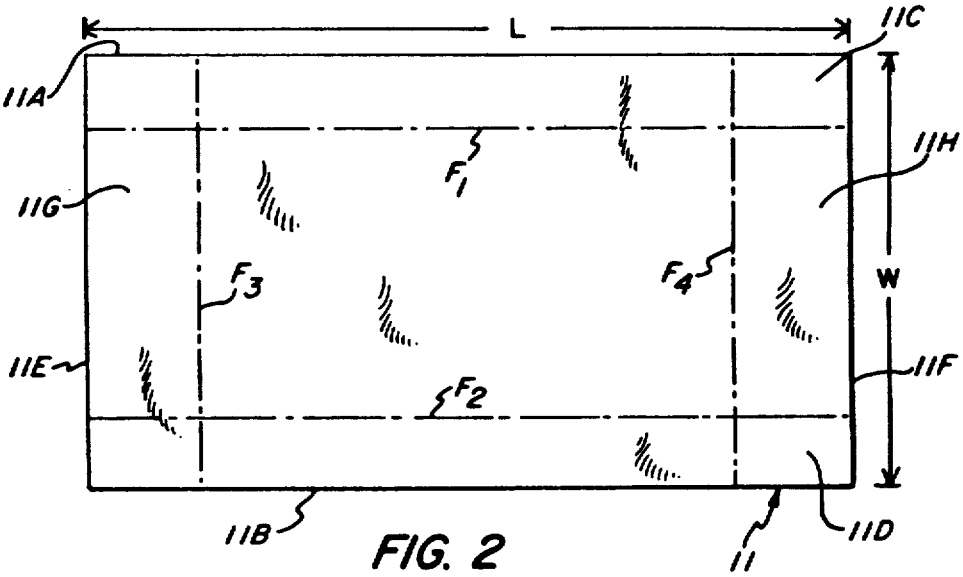
FIG. 2 is a plan view of the blank of material for making the book cover.
Figure 3:
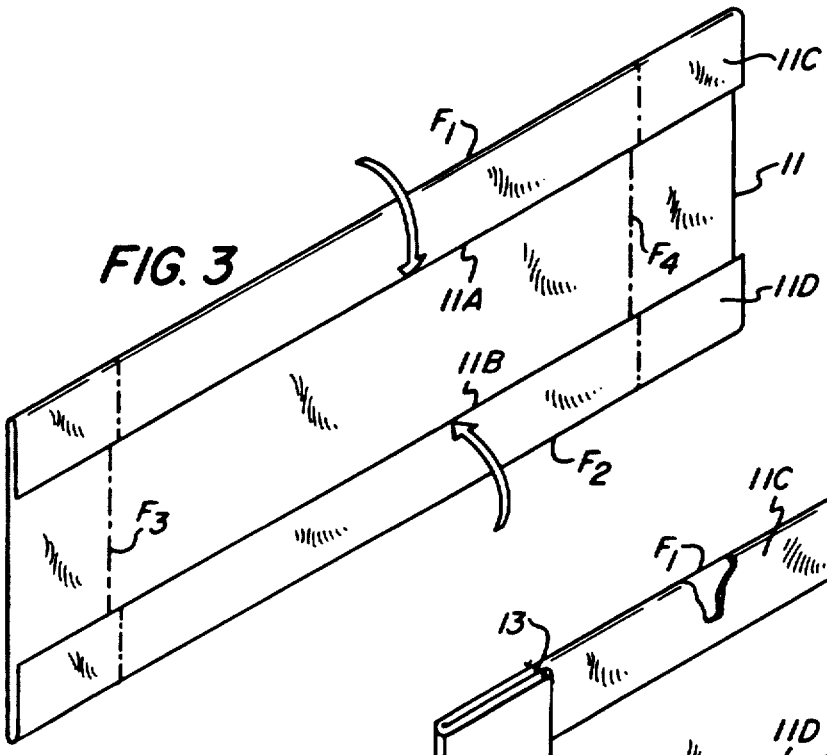
FIG. 3 is a perspective view showing the blank of FIG. 1 in a partially assembled position.
Figure 4:
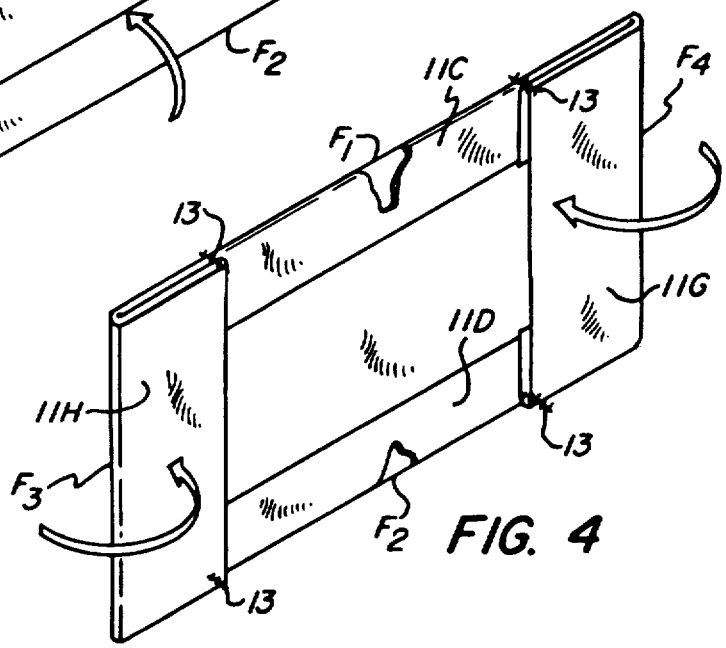
FIG. 4 is a perspective view of the blank in its assembled position.
Figure 5:
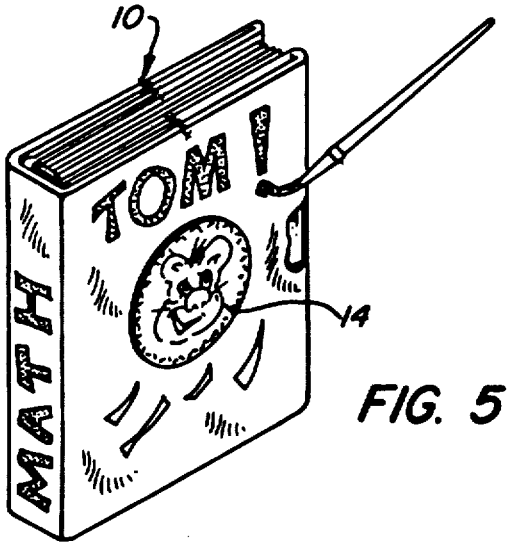
FIG. 5 is a perspective view illustrating the book cover of FIG. 4 as applied to a book.

Referring to the drawings, and more particularly to FIGS. 2 to 5, there is illustrated a book cover embodying the invention. The book cover 10, as shown in FIG. 5, is made from a single sheet or blank of a durable denim material 11. Denim fabric material has been selected because of its soft, durable and washable qualities and for its fashion appeal to young students, who comprise the contemplated consuming users. As shown in FIG. 2, the blank of denim material 11 comprises a generally rectangular pre-cut blank having a predetermined length "L" and width "W", which are determined by the size of the book to be covered. As seen in FIG. 2, the blank 11 may be marked or scored to define opposed longitudinally extending foldlines F1 and F2 extending parallel to the longitudinal edges 11A and 11B of the blank 11. It will be understood that the marking of the location of the foldlines F1 and F2 are not necessary, and only facilitate the location of the foldline for a given size book. The actual location of the foldlines F1 and F2 is determined by the size of the book to be covered. Thus, the foldlines F1 and F2 define with the longitudinal edges 11A and 11B of the blank, a longitudinally extending marginal portion 11C and 11D which are reversely folded onto the blank as best seen in FIG. 3.

A pair of opposed foldlines F3 and F4 extend parallel to the opposed side edges 11E and 11F of the blank 11, to define opposed side marginal portions. Upon reversely folding the longitudinal marginal portions or flaps 11C and 11D onto the blank 11, the opposed side marginal portions 11H and 11G are reversely folded onto the blank 11 as shown in FIG. 4. At the inside corners of the reversely folded side marginal portions 11A and 11G, a fastening means is provided to secure the side marginal portions 11H and 11G to the underlying longitudinal marginal portion, e.g. by a tack stitch 13. Upon the completion of the tack stitch 13 to secure the side marginal portions 11G and 11H to the underlying longitudinal marginal portions 11C and 11D, the book cover is complete. The book to be covered is fitted to the cover 10 by slipping the free edges of the book's outer cover into the respective end pockets formed by the reversely folded side marginal portions 11H and 11G. The upper and lower edges of the book's outer cover are slipped under the pockets defined by the opposed longitudinally reversely folded marginal portions 11C and 11D.

To personalize the completed book cover 10, decorative patches or press-on decals 14 are provided. The patches or press-ons are adhesively backed, whereby they can be applied by contact pressure or heat sealed, e.g. by a hot iron to the outer surface of the book cover 10. Also, in the kit form, suitable paints or colored pigments may be provided whereby the user can paint onto the cover his or her own creative art work, as best seen in FIG. 5.

Because of the fashion appeal of the denim material and the personalizing of the finished cover 10, a basic pride is instilled in the user which further ensures the protection of the book to be covered. It is also contemplated that the use of a book cover as described herein will induce the student to better appreciate the books covered thereby, and thereby enhance the learning process. The book cover thus provides a durable, reusable cover which is attractive, appealing and fashionable in that the book cover will complement the clothes such students generally wear, which are made of like denim material, i.e. jeans and skirts.

Figure 1:
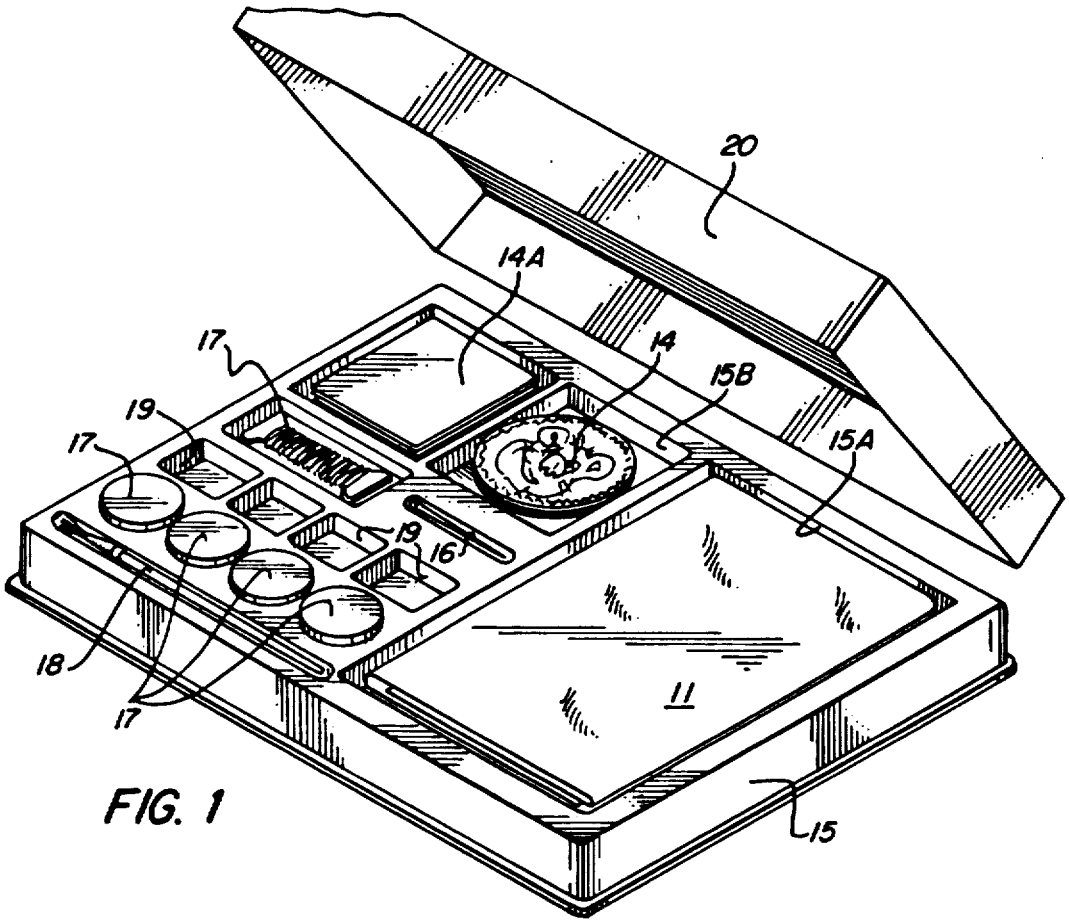
FIG. 1 is a perspective view of a kit embodying the present invention.

To insure a user has the decorative material available to personalize a denim book cover, it is contemplated that the necessary component parts can be marketed in a kit form. Referring to FIG. 1, such a kit may comprise a box or container 15, which can be readily formed of a suitable plastic or paper material, which is compartmentalized to receive the respective component parts. For example, one or more blanks of denim material 11 may be placed in a compartment 15A. The decals or press-on patches 14, 14A may be located in their own compartments 15B and 15C. A needle 16 and thread 17 may also be provided as indicated in FIG. 1. Paints or colored pigments 17 of varying colors may also be provided, together with a suitable artist brush 18. In the event that the colors are water colors, suitable wells are provided in the kit for containing small amounts of water necessary for applying the paints or pigments in creating a design. A suitable cover 20 provides a closure for the kit.

Figure 6:
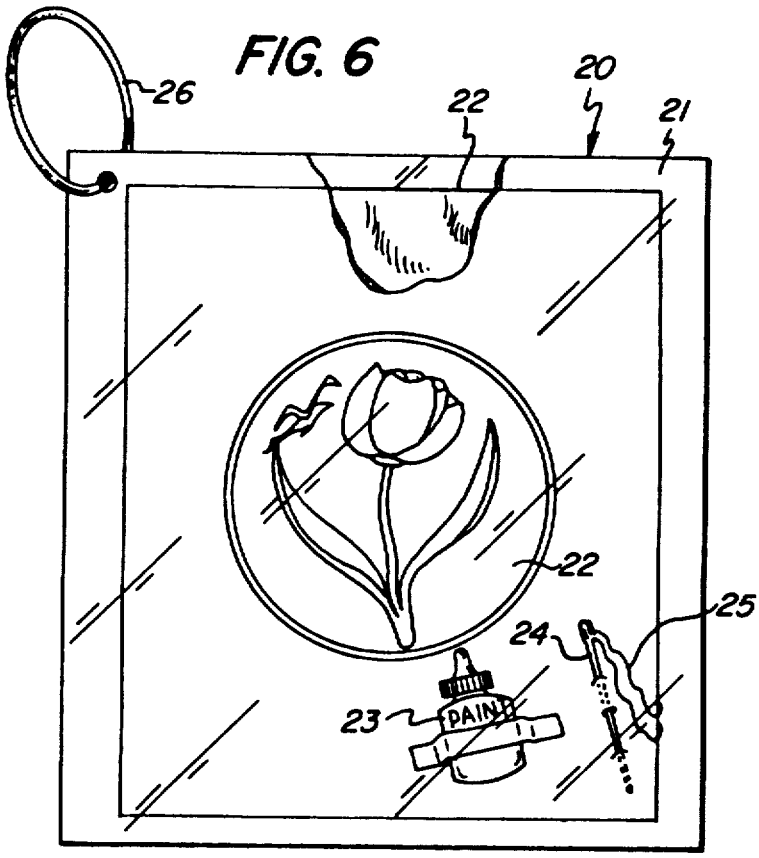
FIG. 6 is a modified kit form.

FIG. 6 illustrates a modified form of a kit 20 embodying the invention. The kit shown in FIG. 6 comprises a plastic see-through bag 21 containing the blank of denim material 22 for making the book cover as hereinbefore described. It will be understood that the blank of sheet denim material is similar to the blank 11 previously described. However, in this form of the invention, the decorative decal or press-on design is pre-attached to the blank, so that the user need not affix the decal or press-on design 22 as hereinbefore described. However, even in the kit form of FIG. 6, means are provided whereby the user could still personalize the cover. This is attained by providing a tube or bottle of pigmented material or paint 23, in which the tube or bottle functions as an applicator for the user to decorate the cover further as herein described. As shown in FIG. 6, the tube or bottle of paint 22 is detachably secured to the blank, as shown by any suitable means, e.g. adhesive tape, contact adhesive and the like. Also attached to the blank is a needle 24, which is pre-threaded with thread 25 as shown. The needle 24 is retained in place by simply having the needle pierce a part of the cover. By so doing, the point of the needle is disposed behind the blank and thus will not pierce the plastic bag 21. A suitable means may be attached to one end of the bag by which the kit form can be readily displayed. In the illustrated embodiment, the hanging means comprises a loop or ring 26 connected to a corner portion of the bag. Thus, the kit form 20 can be readily displayed on suitable counter cards or hooks.

Figure 7:
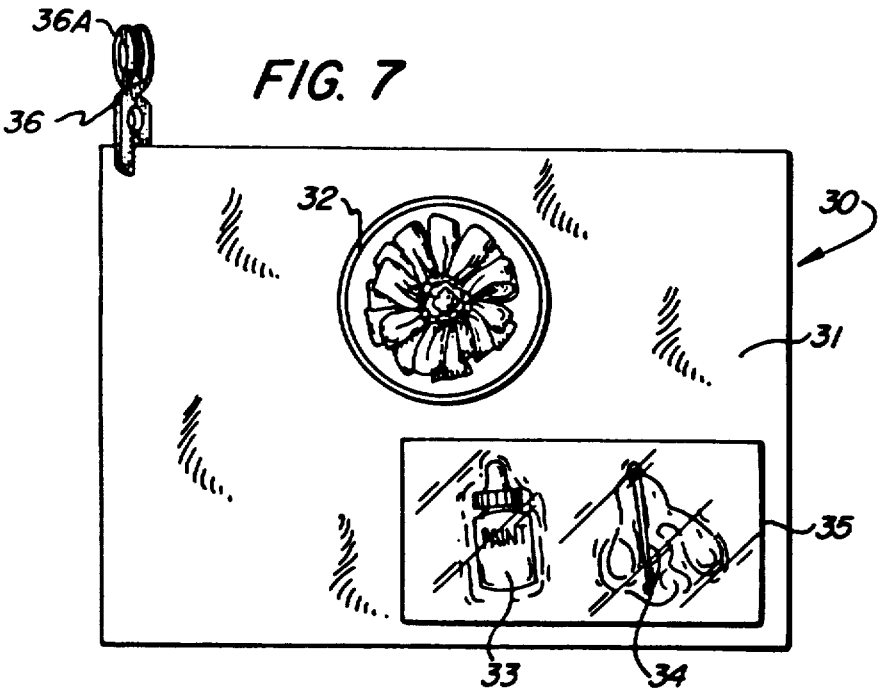
FIG. 7 is a front view of another modified kit form.

FIG. 7 illustrates another modification of a kit form embodying the invention. In this form of the invention, the kit 30 comprises a sheet of denim blank 31 itself, to which the decorative decal or press-on design 32 has been pre-applied, either by sewing or press-on. The additional means for personalizing the book cover comprises a tube or bottle of pigment or paint 33 as described in FIG. 6. The tube or bottle 33 functions as the applicator by which a user could personalize to suit his or her desire. Also included as part of the kit is a pre-threaded needle 34 as hereinbefore described. In this form of the kit, the bottle or tube of pigment 33 and the needle and thread 34 are secured to the blank of denim 31 by means of an adhesively backed patch 35 of clear see-through material, e.g. a clear plastic sheet. As shown in FIG. 7, the patch 35 adhesively secures the pigment and needle to a portion of the blank 31. It will be understood that the patch 35 is releaseably secured to the blank of sheet material 31. Also, the blank of material 31 is constructed as hereinbefore described. To display the kit form of FIG. 7, a hanging means is attached to one edge of the blank 31. In the illustrated embodiment, the hanging means comprises an alligator clip 36 having a ring 36A connected to the free end thereof. However, it will be understood that other types of hangers can be provided. To display the kit form of FIG. 7, the ring 36A can be readily attached to a suitable display hook. In this embodiment, the kit requires no external packaging as the blank of denim material per se constitutes the packaging; which greatly simplifies the packaging and reduces, if not eliminates, the packaging cost to result in an ultimate saving to the consumer.

From the foregoing, it will be apparent that a student can fabricate and decorate a durable, sturdy and fashionable book cover in accordance with his or her own creative abilities, which will instill pride for the books covered thereby and which may well enhance the learning process.

While the invention has been described with respect to a particular embodiment thereof, it will be understood that variations and modifications may be made without departing from the spirit or scope of the invention.

What is claimed is:

1. A do-it-yourself book cover kit comprising a blank sheet of denim material sized to form a book cover, a decorative design pre-attached to said sheet, a tube of pigmented material, and a pre-threaded needle, means for detachably connecting said tube of pigmented material and said pre-threaded needle directly to said blank of sheet material, and means connected to said blank of sheet material for displaying the kit.

2. A do-it-yourself book cover kit as defined in claim 1 wherein said means for connecting said tube of pigment and said pre-threaded needle directly to said sheet material comprises a patch of clear see-through material, said patch being adhesively backed whereby said bottle and pre-threaded needle are detachably secured directly to said sheet by overlaying and adhesively securing said patch directly to said sheet of material, said tube of pigment and pre-threaded needle being retained between said sheet of material and said patch.

3. A do-it-yourself book cover kit as defined in claim 1 wherein said blank sheet comprises a rectangular blank of a denim fabric;

said blank having opposed longitudinal edges and opposed side edges;

a foldline paralleling each of said longitudinal edges and opposed side edges to define reversely foldable opposed longitudinal marginal portions and reversely foldable opposed marginal side portions;

said opposed longitudinal marginal portions being reversely folded onto said blank;

and said marginal side portions being reversely folded onto said blank;

said reversely folded side portions defining end pockets for receiving the free ends of a book cover;

and said reversely foldable longitudinal marginal portions defining opposed pockets for receiving the upper and lower edges of a book cover;

and means for securing said reversely folded side portions to said longitudinal marginal portions in the folded position.

* * * * *